US011504756B2

(12) United States Patent
Low et al.

(10) Patent No.: US 11,504,756 B2
(45) Date of Patent: Nov. 22, 2022

(54) METHOD OF ALIGNING A FLAT OR PROFILED METAL SHEET

(71) Applicant: Hydroform Pte. Ltd., Singapore (SG)

(72) Inventors: Hock Hai Low, Singapore (SG); Yee Cheng Chew, Singapore (SG)

(73) Assignee: Hydroform Pte. Ltd., Singapore (SG)

( * ) Notice: Subject to any disclaimer, the term of this patent is extended or adjusted under 35 U.S.C. 154(b) by 236 days.

(21) Appl. No.: 16/615,915

(22) PCT Filed: May 17, 2018

(86) PCT No.: PCT/SG2018/050241

§ 371 (c)(1),
(2) Date: Nov. 22, 2019

(87) PCT Pub. No.: WO2018/217164

PCT Pub. Date: Nov. 29, 2018

(65) Prior Publication Data

US 2020/0139417 A1 May 7, 2020

(30) Foreign Application Priority Data

May 23, 2017 (SG) ..... 10201704185Y

(51) Int. Cl.

| | |
|---|---|
| ***B21D 5/00*** | (2006.01) |
| ***B21D 5/14*** | (2006.01) |
| ***B21D 5/16*** | (2006.01) |
| ***F15B 1/26*** | (2006.01) |

(Continued)

(52) U.S. Cl.

CPC ..... *B21D 5/002* (2013.01); *B21D 5/004* (2013.01); *B21D 5/14* (2013.01); *B21D 5/16* (2013.01);

(Continued)

(58) Field of Classification Search

CPC ..... B21D 5/002; B21D 5/004; B21D 5/06; B21D 5/08

(Continued)

(56) References Cited

U.S. PATENT DOCUMENTS 3,115,999 A * 12/1963 Wythe ..... B65B 41/18 226/32
5,970,769 A * 10/1999 Lipari ..... B21D 5/02 72/181

(Continued)

FOREIGN PATENT DOCUMENTS

EP 0132819 A1 * 2/1985 ..... B21C 47/34
JP S5966925 A 4/1984

(Continued)

OTHER PUBLICATIONS

International Search Report of PCT/SG2018/050241 dated Aug. 28, 2018, in English.

(Continued)

*Primary Examiner* — Jessica Cahill
*Assistant Examiner* — Jared O Brown
(74) *Attorney, Agent, or Firm* — Collard & Roe, P.C.

(57) ABSTRACT

A method of aligning a flat or profiled metal sheet with preformed notches on the two sides of the metal sheet when the sheet enters into a bender or folding machine directly from a roll forming machine linked or joined to the folder. The metal sheet has to be effectively aligned on the folder before folding to avoid potential damages to the metal sheet of not being properly squared or angled on bending while reducing the times to produce the folded products. Moreover, this method according to the invention allows the metal sheet to feed directly into the folder from the rollformer without having to pass through an intermediary transfer (Continued)

table or aligning device/machine before entering the folder for folding or manual alignment in the folder.

10 Claims, 6 Drawing Sheets

(51) Int. Cl.
*F15B 11/042* (2006.01)
*F15B 15/20* (2006.01)

(52) U.S. Cl.
CPC ..... *F15B 1/26* (2013.01); *F15B 11/042* (2013.01); *F15B 15/202* (2013.01)

(58) Field of Classification Search
USPC ..... 72/176, 179, 181
See application file for complete search history.

(56) References Cited

U.S. PATENT DOCUMENTS

| | | | | |
|---|---|---|---|---|
| 7,426,884 | B2 * | 9/2008 | Thiry | F15B 11/0445 91/512 |
| 8,225,636 | B2 * | 7/2012 | Borwig | B21D 39/02 72/176 |
| 2016/0068092 | A1 * | 3/2016 | Duell | F15B 15/1409 91/176 |
| 2019/0022734 | A1 * | 1/2019 | Kitamoto | B21D 43/287 |

FOREIGN PATENT DOCUMENTS

| | | | | |
|---|---|---|---|---|
| JP | S6272434 | A | 4/1987 | |
| JP | H03118927 | A | 5/1991 | |
| JP | 09295083 | A * | 11/1997 | |
| JP | H11267760 | A | 10/1999 | |
| JP | 2008168992 | A | 7/2008 | |
| JP | 2009179438 | A | 8/2009 | |
| JP | 2003245719 | A | 9/2009 | |
| JP | 2011242534 | A | 12/2011 | |
| WO | WO-8701977 | A1 * | 4/1987 | B21D 5/08 |

OTHER PUBLICATIONS

Written Opinion of the International Searching Authority dated Aug. 28, 2018, in English.

* cited by examiner

Side View

Autofold Fabri Flange Series Diagram

Autofold Fabri Flange Parallel Diagram

METHOD OF ALIGNING A FLAT OR PROFILED METAL SHEET

CROSS REFERENCE TO RELATED APPLICATIONS

This application is the National Stage of PCT/SG2018/050241 filed on May 17, 2018, which claims priority under 35 U.S.C. § 119 of Singapore Application No. 10201704185Y filed on May 23, 2017, the disclosure of which is incorporated by reference. The international application under PCT article 21(2) was published in English.

BACKGROUND OF THE INVENTION

At least one embodiment of the present invention relates to a method of aligning a flat or profiled metal sheet with preformed notches directly opposite to each other on two sides of a sheet. In particular, in at least one embodiment, there is a profiled HVAC ducting sheet which is configured to be shaped by a rollformer which requires the first fold line of the metal sheet to be properly aligned on the folding line of the mechanical folder for accurate folding of the profiled metal sheet. The rollformer has two sets of rollers which move the metal sheet while forming the profile on the flat sheet with preformed notches.

Currently, in the production line of HVAC duct fabrication, the process from a profile formed on the preformed notched flat metal sheet by a rollformer to the next process of folding the profiled metal sheet by a folder, the folder is not directly joined or linked together with the rollformer.

Before feeding the profiled metal sheet from exiting the rollformer into the folder, there is either a mechanical transfer table as a go between to link and join the rollformer and the folder together, or if the rollformer and the folder are separated, not linked nor joined; manpower is used to transfer the profiled metal sheet from the rollformer into the folder for folding.

Each of the exiting profiled metal sheets from the rollformer has to be aligned with its first fold line to the folding line of the folder before precise folding can be effected by the folder. This alignment can be done manually by aligning the first fold line formed from the first corresponding set of preformed notches directly opposite each other on the two sides of the metal sheet with the folding line of the folder.

Once the profiled metal sheet first fold line is aligned by sitting or positioning itself directly ontop of the folding line of the folder, the folder will carry out the first folding on the fold line and subsequent folds on the same profiled metal sheet will be carried out on the subsequent fold lines accurately as the first fold is aligned. The number of folds on the metal sheet will depend on the number of fold lines created by the preformed notches. The number of folds ranges generally from one fold which formed a L shaped product to three folds forming a box up.

Where alignment is carried out by a transfer table to align a profiled metal sheet before entering the folder, a mechanical pusher is used to square and align the metal sheet first. In manual alignment, the metal sheet is manually placed on the folder with the first fold line positioning directly ontop of the folding line of the folder.

The traditional and current solution normally provides for mechanical alignment using a transfer table with gripper and pusher or manual alignment by transferring and positioning the profiled metal sheet exiting the rollformer onto the folder.

Without the mechanical transfer table or aligning table, it will be troublesome, problematic, time and labour consuming to physically align each profiled or flat sheet on the folder.

The current or traditional solution using a transfer table or manually to align the profiled or flat metal sheet on the folder has the following disadvantage— a) Additional space is required to place the transfer table or space required for labour to work between the rollformer and the folder;

b) Additional cost and maintenance expenses of the mechanical transferab e or the extra labour to carry out the alignment before folding or bending;

c) The additional time travelled on the transfer table or space between rollformer and the folder;

d) Additional utility cost of operating the transfer table; and e) Extra manpower to operate the transfer table or manual alignment.

Thus, there is a need to provide a method of aligning the profiled sheet directly from the rollformer before folding by the folder which overcome the need of having the transfer table or manual feed from the rollformer to the folder and aforesaid disadvantages.

SUMMARY OF THE INVENTION

In at least one embodiment there is an aligning method for flat or profiled metal sheets with preformed notches on the two parallel sides of the metal sheet in which the direct opposite side preformed notches will match each other to create a fold line and the first fold line will have to be aligned to the folding line of mechanical folder before the folding of the metal sheet.

The profiled metal sheet first fold line has to be effectively aligned to the folding line of the folder, to avoid potential damages and disruption to the production line due to inconsistent angularity problems of the sheet when folding, thus reducing the production time and manpower in producing the folded products of HAVC ducts.

This design and process is used to negate the use of transfer table or labour for alignment of the metal sheet which translate to cost, time and space savings.

Therefore, at least one embodiment of the present invention is configured to provide an aligning method for aligning the flat or profiled metal sheet with preformed notches exiting from the rollformer machine before folding by the preceding folder machine.

The method is configured to have controllers control sensors so that they co-operate on the folder with rollformer valves and hydraulic motors, which allows the first fold line of the profiled metal sheet to be aligned with the folding line on the folder before folding.

BRIEF DESCRIPTION OF THE DRAWINGS

Further features and advantages of the invention will be more apparent in light of the detailed description of a preferred, but not exclusive, embodiment of the method of aligning each of the fold lines of the metal sheet with the folding line of the mechanical folder, shown by way of non-limiting example, with the aid of the accompanying drawings in which.

In the drawings, wherein similar reference characters denote similar elements throughout the several views.

The same reference numbers in the figures identify the same elements or components.

DETAILED DESCRIPTION

Figure 1A:
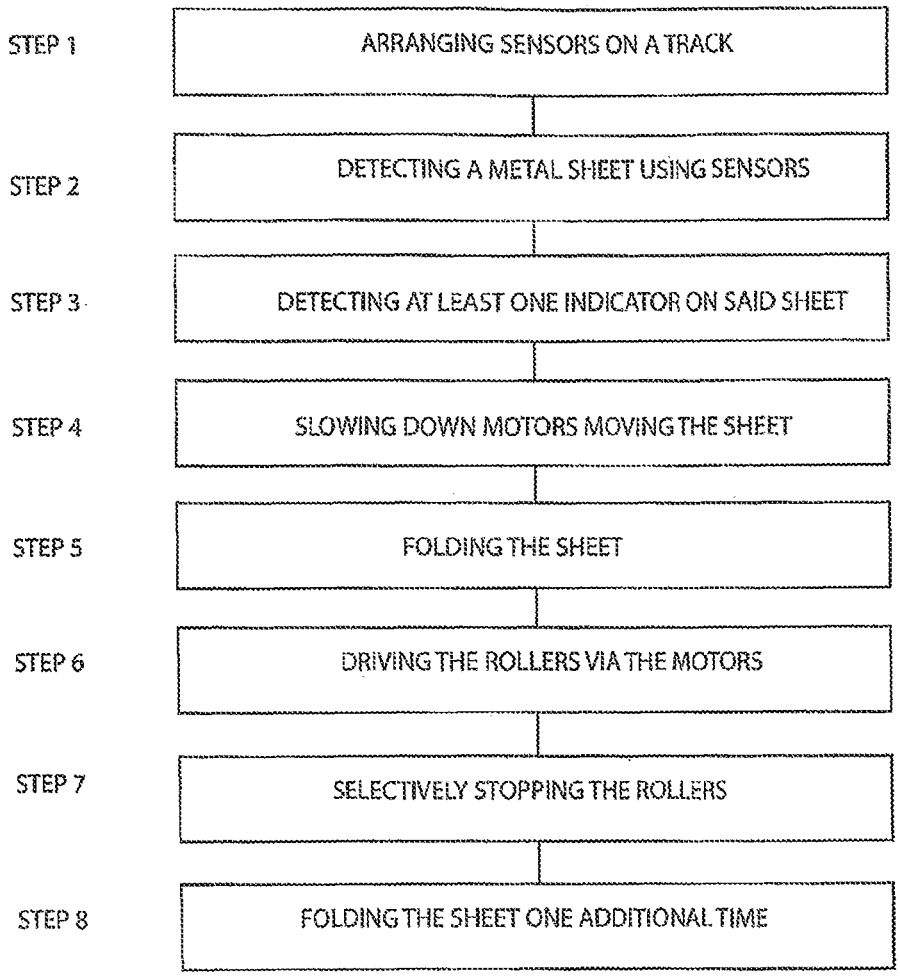
FIG. 1A is a flow chart for the process of at least one embodiment.
Figure 1B:
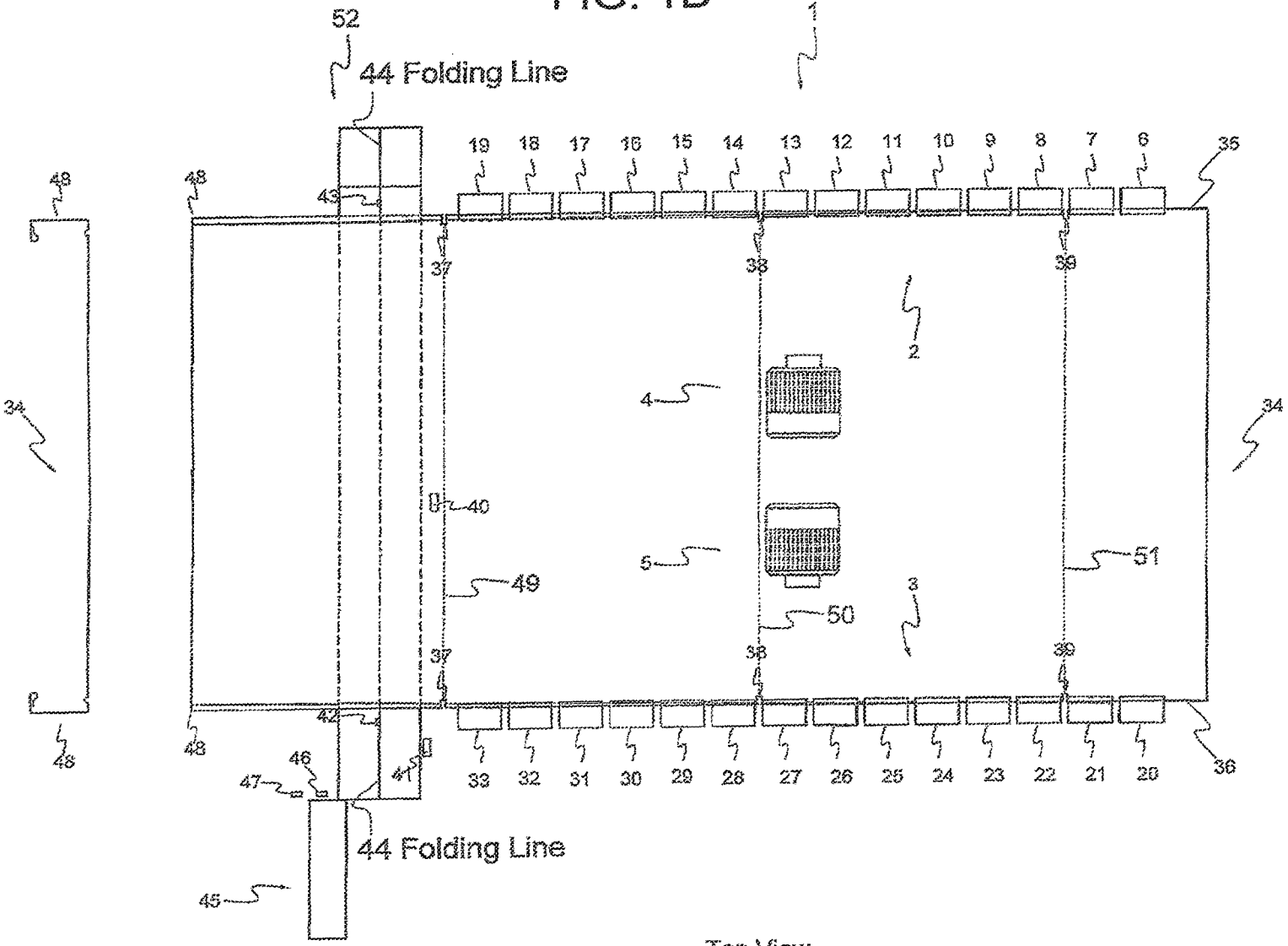
FIG. 1B shows the plan view of the method used co-operating the rollformer with the mechanical folder according to the invention.
Figure 3:
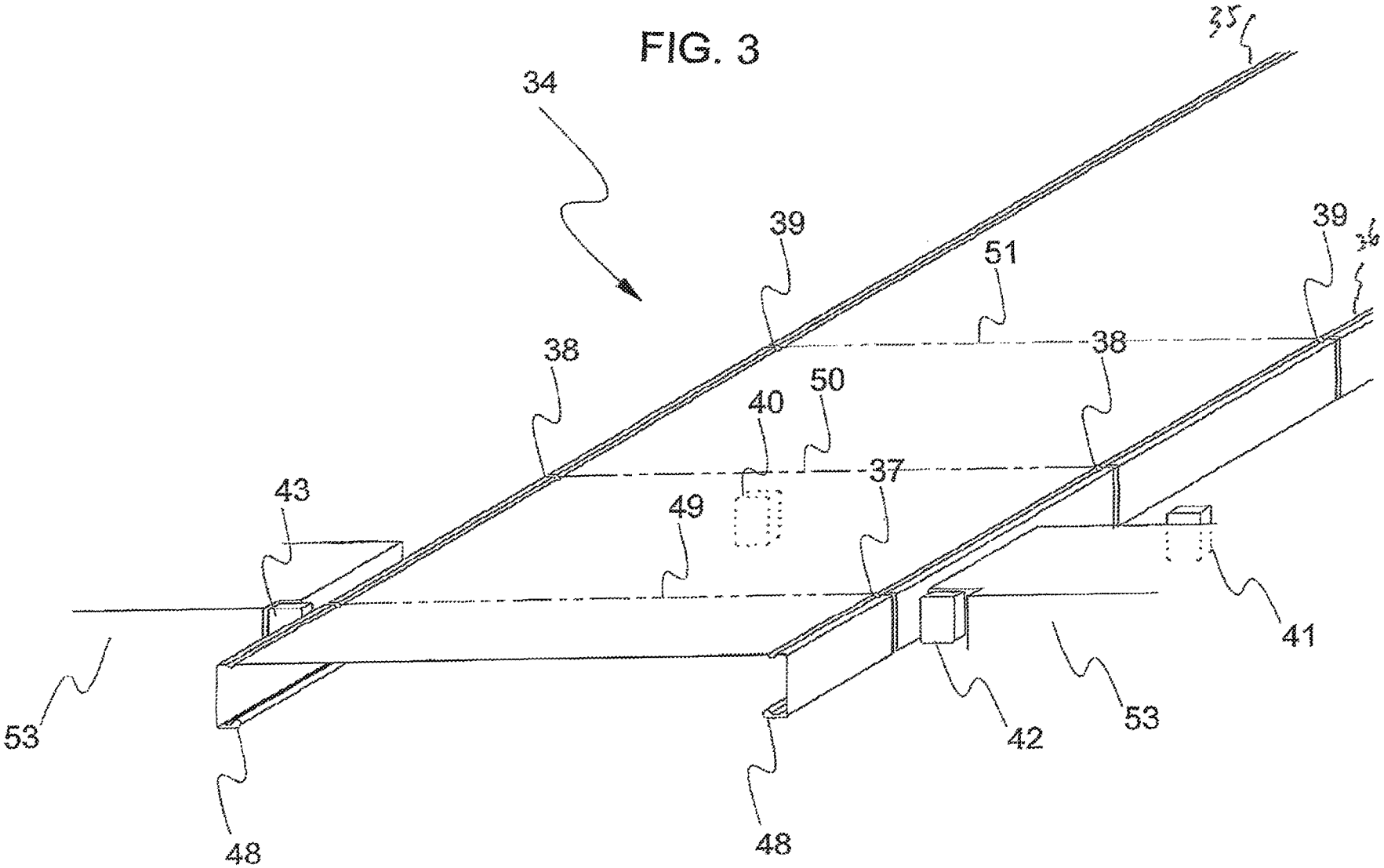
FIG. 3 shows the 3D view of the sensors' position in detecting the metal sheet phases of travel in the mechanical folder according to the invention.

Referring to the drawings, FIG. 1A shows a flow chart for the process for aligning a square or rectangular, flat or profiled metal sheet on a rollformer. With this embodiment, the process shown in FIG. 1A is explained in further detail below. For example, in step 1 there is the step of arranging sensors on a folder. This step can include arranging a plurality of different sensors such as sensors 40, 41, 42, 43 as shown in FIG. 1B and FIG. 3. Next, in step 2 the process includes detecting the metal sheet such as sheet 34 using at least one of these sensors. In at least one embodiment all of the sensors 40, 41, 42, and 43 are used. Next, in step 3 this can include detecting at least one indicator on the sheet such as any one of notches 37, 38 and 39 on the sheet or roll 34. Next in step 4 the process includes the step of slowing down motors which are moving the sheet through the folder 52 or rollformer 1. Next in step 5, the process includes folding the sheer along a bend/fold line. Next, in step 6, the process includes re-initiating the rollers and driving the rollers such as rollers 6-17 and rollers 18-30. Next, in step 7, the process includes selectively stopping the rollers again so that in step 8 the process can include folding the sheet at least one additional time.

FIG. 1B shows a design of a rollformer for use with the above method of aligning the square or rectangular, flat or profiled metal sheet 34 on a rollformer 1 having rollers 6-19 on one side 35 with an opposite set of rollers 20-33 on the opposite side 36. The roll 34 has pre-formed notches 37, 38, 39 on the two sides 35 & 36 of the metal sheet where the directly opposite notches will match each other in a straight line creating fold line 49, 50, 51. These fold lines 49, 50, 51 are the specific position for the folding of the metal sheet 34 to occur.

For the metal sheet to be folded properly without damage, each of the fold lines 49, 50, 51 need to be aligned to the folding line 44 of the mechanical folder 52, with the metal sheet first fold line 49 sits directly on top of the folder folding line 44 for the first folding of the sheet to begin.

Subsequent folding of the metal sheet will occur on the remaining fold lines 50, 51 being aligned with the folding line 44 of the folder 52. The number of required folds on the metal sheet will be dictated by the equal number of fold lines on the metal sheet.

The aligning method encompassed the use of sensors 40, 41, 42, 43, valves 61, 65, 71, hydraulic motors 4,5 and controller 45.

The description of this method applies also to the case of alignment of plates before folding on exit from a rollformer or any conveying machine.

Aligning the preformed notched metal sheet 34 means placing or positioning each fold line 49, 50, 51 of the metal sheet 34 directly on top of the folding line 44 of the folder 52 for folding by the folder 52.

The metal sheet 34 is moved by the two working sets of rollers of the rollformer 6 to 19 & 20 to 33 for the metal sheet 34 to exit the rollformer 1 and to enter directly into the mechanical folder 52.

Figure 4:
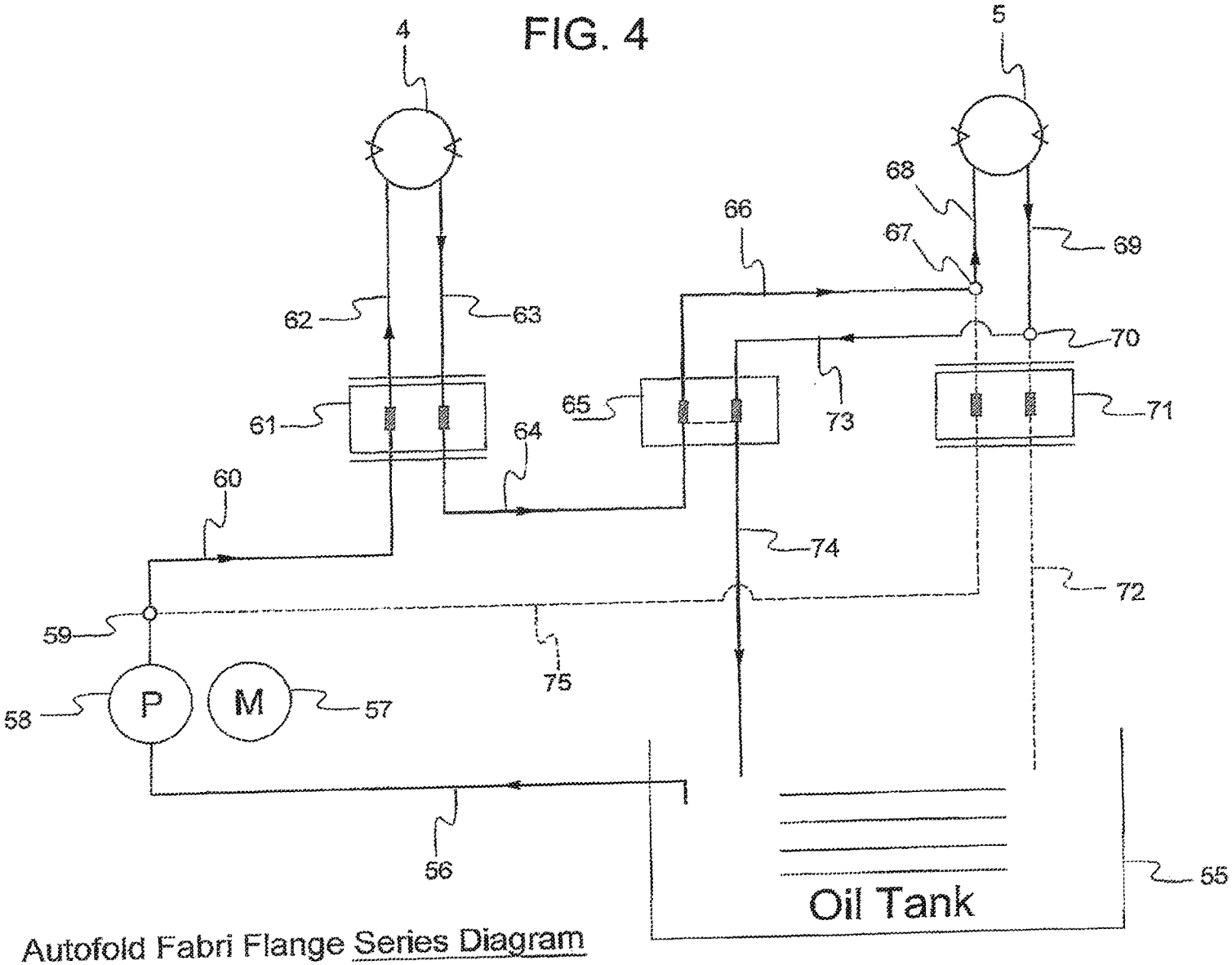
FIG. 4 shows the series circuit operation sequence of oil flow actuating the hydraulic motors of the rollformer according to the invention.

The two sets of rollers 6 to 19 & 20 to 33 are individually actuated by each respective hydraulic motors 4 & 5 in a series circuit. FIG. 4 shows a schematic block diagram of hydraulic oil flow when the metal sheet enters the rollformer 1.

In the series circuit, the direction of hydraulic oil flow is in one single line of flow 55-56-58-59-60-62-63-64-66-67-68-69-70-73-74-55 with the two valves 65 open and 71 closed directing this single directional continuous oil flow to the both hydraulic motors 4 & 5.

In a series circuit of oil flow the two motors 4 & 5 are actuated simultaneously hence driving the both sets of rollers moving at the same speed. If the fold line 49 of the metal sheet 34 is not parallel to the folding line 44 of the folder, there is misalignment of the metal sheet and the two set of rollers moving at the same speed which in turn move the sheet plate at the same speed will not able to correct the misalignment.

Therefore, the metal sheet first fold line 49 will not be parallel to the folding line 44 of the folder 52 which will not be aligned upon reaching the folder 52 folding line 44. Hence, all other subsequent fold lines 50, 51 if any will not be aligned too.

Figure 5:
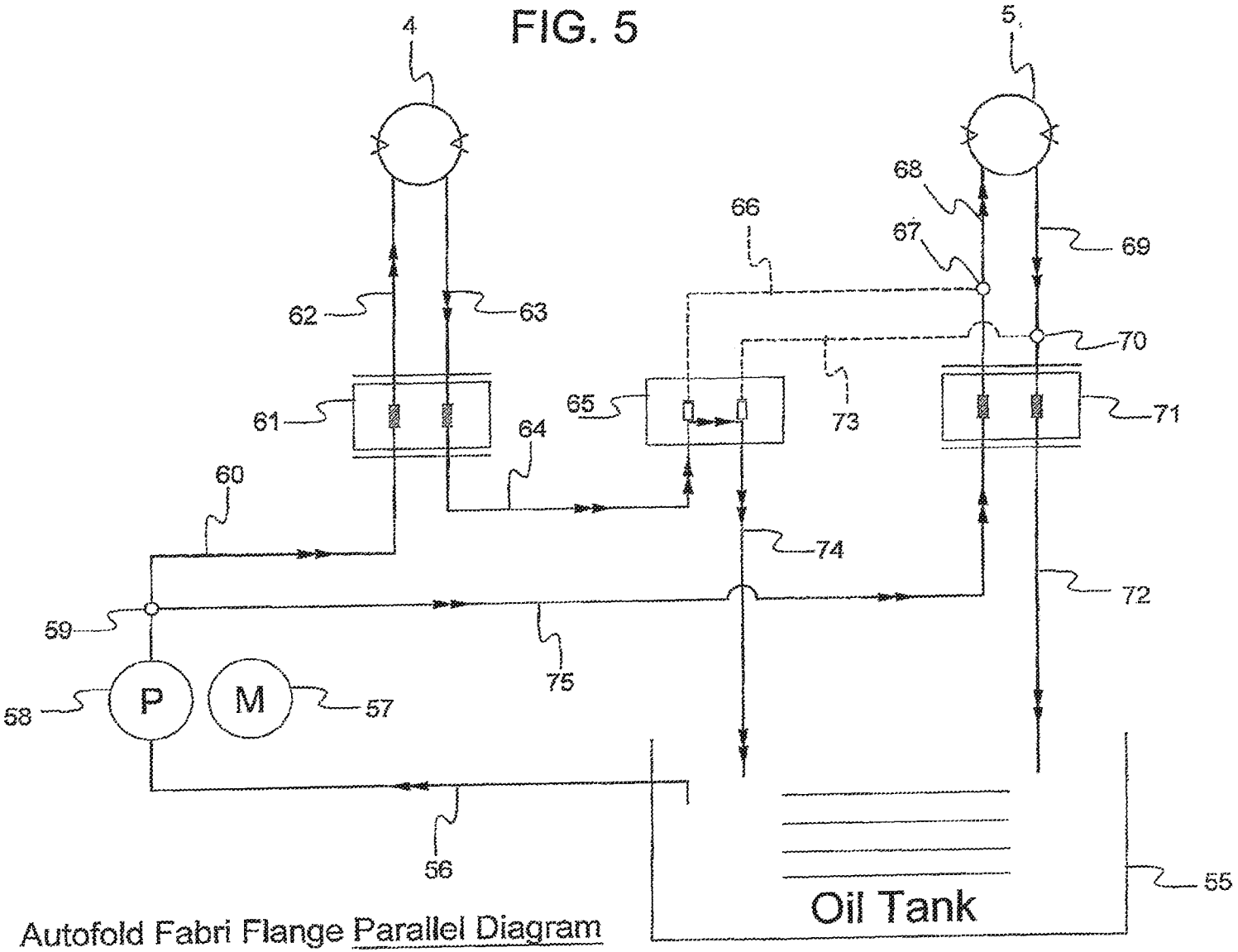
FIG. 5 shows the parallel circuit operation sequence of oil flow actuating the hydraulic motors of the rollformer according to the invention.

To adjust the alignment so that the fold line 49, 50, 51 of the metal sheet will sit or position directly above the folding line 44 of the folder 52, the motors 4,5 must move individually driving both sets of the rollers 6-19 & 20-33 at different speed in which the oil flow must be in a parallel circuit See FIG. 5. With the two sets of rollers 6-19 & 20-33 at different speed, the metal sheet 34 can be adjusted to compensate for the difference in the alignment until alignment is achieved.

One method of aligning the metal sheet invention is by:

A Arranging, positioning and configuring the sensors 40, 41, 42, 43 mounted on the folder 52 to detect and track the position of the metal sheet on entering and during its journey in the folder 52;

B The first sensor 40 upon detecting the metal sheet 34 first entry into the folder will signal the programed controller 45 to trigger the motors 4, 5 to slow down the speed of all the rollers 6-19 & 20-33;

C When the 2nd sensor 41 detects the metal sheet 34, a signal will be sent to the controller to activate the switching of the hydraulic oil flow powering the motors from the initial series circuit See FIG. 4: 55-56-58-59-60-62-63-64-66-67-68-69-70-73-74-55 of single line flow to parallel circuit of dual oil flow powering motor 4 See FIG. 5: 55-56-58-59-60-62-63-64-74-55 and motor 5 See FIG. 5: 55-56-58-59-75-67-68-69-70-72-55. Thereby both the motors in the initial series circuit oil flow which move the two sets of rollers 6 to 19 & 20 to 33 simultaneously at same speed will upon switching to parallel circuit with the motors now actuating the rollers 6 to 19 & 20 to 33 moving at different new speed.

Figure 2:
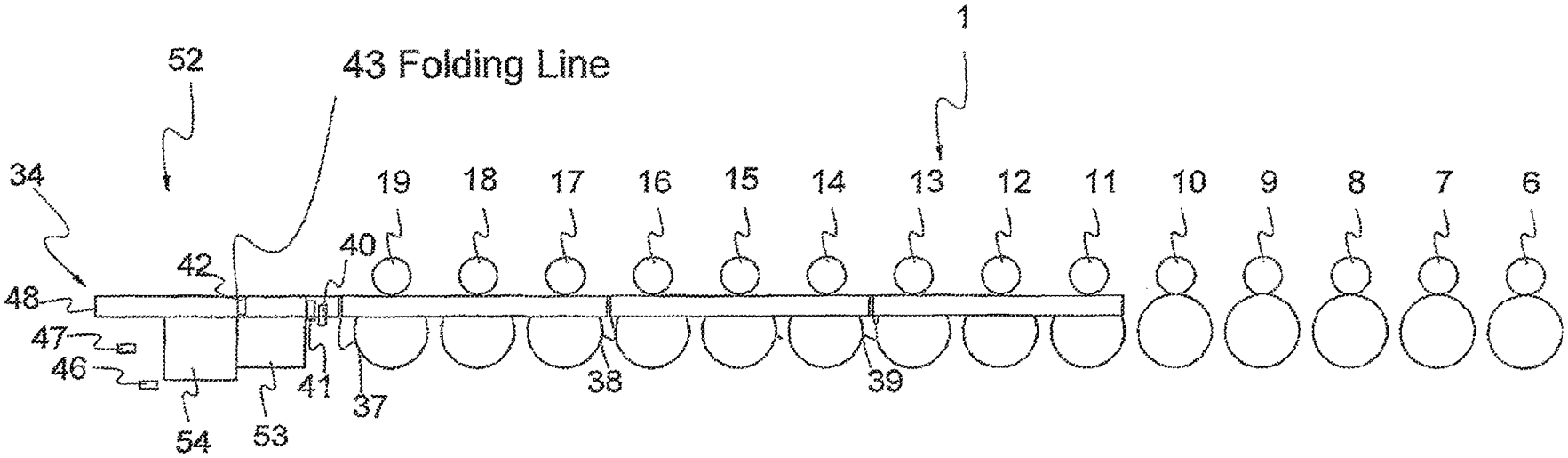
FIG. 2 shows the side view of the method used co-operating the rollformer with the mechanical folder according to the invention.

D The 3rd or 4th sensor 42, 43, is positioned as shown in FIGS. 1B, 2 and 3 on the folder to detect the notch on the respective sides 36, 35 of the metal plate. When either one of these 3rd or 4th sensors first detect the preformed notches 37 on the side 35 or 36 of the metal sheet, it will signal the controller to immediately stop the respective motor sensor 43 to motor 4, sensor 42 to motor 5 thereby actuating the respective set of rollers motor 4 to rollers 6 to 19 & motor 5 to rollers 20 to 33 to stop moving. Subsequently, the other sensor will detect the preformed notch and will signal to the controller to stop the motor which in turn stopped the respective moving roller.

E Thereby, the metal sheet will stop with its first fold line 49 aligned by being seated directly on top of the folding line 44 of the folder 52.

F The controller 45 is programed to control the opening and closing of the valves 61, 65, 71 which in turn control the amount of oil flow through the valves actuating the two motors from series circuit to parallel oil flow. The oil flow is configured to control the motors 4 & 5 actuating the movement of the respective rollers 6 to 19 & 20 to 33 moving the sheet 34.

G The controller 45 is also programed to control the folding operation of the folder 52. Upon the completion of all the folds along the fold lines 49, 50, 51 of the metal sheet 34, the controller 45 will trigger the reversion of the parallel circuit oil flow to series lEl oil flow hence both motors 4 & 5 will move simultaneous likewise the two sets of rollers 6 to 19 & 20 to 33 moving at the same speed.

H The process of alignment will repeat for the next incoming metal sheet.

A preferred variation depicting the method is shown in FIG. 1B, 2, 3 for the 4 numbers of sensors 40, 41,42, 43 mounted on the folder 52 and FIGS. 4 & 5 for the hydraulic oil directional series and parallel circuit flow controlled by the valves 61, 65, 71 actuating the two hydraulic motors 4 & 5 which powered the speed of the two set of rollers 6 to 19 & 20 to 33.

All sensors 40,41,42,43 are of laser source type AND alternative to sensor 40, optical or LED type can be used instead.

The positions of the sensors are important to accurately detect the metal sheet and is preferred to be mounted on the position as in FIG. 3—Sensor 40 being the first sensor at the lower parr and about 50 mm away from the folder 52 to detect the metal sheet which is travelling above the sensor.

Sensor 41 being the 2nd sensor positioned along either ends of the edge of the folder 52 facing the rollformer when the metal sheet will first enter the folder 52 and at the height of the folder 52 that the side of the metal sheet will definitely pass to be detected by the sensor.

Sensor 43 and 42 being the 3rd & 4th sensor at the position is just before the folding line 44 and height of the folder where the notches at sides 48 of the metal sheet that will pass to be detected by the sensors 46, and 47.

Alternatively, any of the sensors can be at any position that can detect the above specific parts of the metal sheet. All of the sensors are linked to the pre-programmed controller 45 and on each sensor detecting the specific parts of the metal sheet, it will signal the controller 45 to respond by the first sensor 40 upon detecting the metal sheet 34 first entry into the folder will signal the controller 45 to trigger the hydraulic motors 4, 5 to slow down all the speed of all the rollers 6 to 19 & 20 to 33. The second sensor 41 upon detecting the side of the metal sheet will signal the controller to switch the hydraulic oil flow powering both motors 4 & 5 from the initial series circuit of single line flow chart of FIG. 4 to parallel circuit flow shown in FIG. 5. Thereby, the motors will change their initial same actuation of the two sets of rollers simultaneous movement of same speed to parallel circuit with the motors now actuating the rollers 6 to 19 & 20 to 33 moving at new different speed.

When either one of the third or fourth sensors 42, 43 first detects the preformed notch 37 on the sides 35 and 36 of the metal sheet, it will signal the controller to trigger the respective motor sensor 43 to motor 4, sensor 42 to motor 5 to actuating the respective set of rollers motor 4 to rollers 6 to 19 & motor 5 to rollers 20 to 33 to stop. Subsequently, the other sensor will detect the preformed notch and will signal to the controller to trigger the stopping of the motor which in turn stopped the moving roller.

Thereby the metal sheet will stop with its first fold line 49 aligned being seated directly on top of the folding line 44 of the folder 52 ready for folding by the folder 52. The controller is pre-programed to control the opening and closing of the valves 61, 65, 71 and also the amount of oil flow which will actuate the two motors from series circuit oil flow to parallel oil flow.

The notches 37, 38,39 are formed on the sides 35, 36 of the flat sheet before entering the rollformer 1. Each notch on each side of the flat sheet are formed to match each other creating a fold line 49, 50, 51 for each fold on the metal sheet.

For better understanding, if the metal sheet is to be folded into a box shape as in closed box duct, there will be three (3) folds to complete a box hence there will be three (3) notches on each side of the metal sheet. If just a L shaped product, then a single fold with one fold line is suffice. The rollformer is to create profile at the sides 35, 36 of the metal sheet where the profile formed on the flat sheet is created by the rollformer.

Upon exiting the rollformer 1 into the adjacent mechanical folder 52 where both the rollformer 1 and the mechanical folder 52 are actuated by the pre-programmed controller 45 relying on the sensors 40, 41, 42, 43 detection to control each phase of movement in aligning the metal sheet.

The fold line 49, 50, 51 of the metal sheet on exiting the rollformer 1 will not be parallel to the folding line 44 of the folder 52; hence not aligned and each fold line 49, 50, 51 will not sit directly on top of the folding line 44.

Thus, this system and process removes the requirement for a multi-step process requiring multiple users to move different sheets to different machines to effect folding of materials.

Accordingly, while at least one embodiment of the present invention have been shown and described, it is to be understood that many changes and modifications may be made thereunto without departing from the spirit and scope of the invention as defined in the appended claims.

What is claimed is:

1. A method for aligning a sheet, comprising:

providing a roll former comprising a plurality of sets of rollers, a plurality of motors, a plurality of sensors, and a folder;

arranging the plurality of sensors to detect and track a position of the sheet on the roll former;

detecting the sheet using a first sensor of the plurality of sensors during a first entry of the sheet into the folder, wherein said first sensor will signal a programmed controller to trigger at least one of said plurality of motors to slow down a speed of all of the plurality of sets of rollers;

identifying the sheet using a second sensor of the plurality of sensors;

driving each of the plurality of sets of rollers via a corresponding one of the plurality of motors;

detecting a first notch on a side of the sheet using a third sensor of the plurality of sensors, and using a fourth sensor of the plurality of sensors to detect a second notch located on an opposite side of the sheet relative to the first notch, wherein the third and the fourth sensors are positioned on the folder;

slowing down said plurality of motors driving said plurality of sets of rollers;

signaling the controller to immediately stop said plurality of motors, and thereby the plurality of sets of rollers and the sheet, when a first fold line on the sheet is in line with a fold line on the folder;

folding the sheet;

driving said plurality of sets of rollers via said plurality of motors to move the sheet to a second position wherein a second fold line is in line with the fold line on the folder;

selectively stopping said plurality of sets of rollers a second time;

folding the sheet at least one additional time;

wherein the method also includes the steps of:

sending a signal to the controller to activate a switching of a hydraulic oil flow powering the plurality of motors from an initial series circuit of single line oil flow to a parallel circuit of dual oil flow; and wherein the initial series circuit controls the plurality of motors such that the plurality of sets of rollers rotate at substantially a same speed, and wherein the switching of the hydraulic oil flow from the initial series circuit to the parallel circuit controls the plurality of motors such that the plurality of sets of rollers rotate at different speeds relative to one another.

2. The method as in claim 1, wherein the step of folding the sheet comprises a step of stopping the sheet along the first fold line on the sheet, which is aligned by being seated directly on top of the fold line of the folder.

3. The method as in claim 1, wherein the controller is programmed to control an opening and closing of a plurality of valves, wherein the opening and closing controls an amount of oil flow through the plurality of valves, thereby actuating the plurality of motors from the initial series circuit to the parallel circuit.

4. The method as in claim 3, wherein the oil flow is configured to control the actuation of the plurality of motors which in turn control the speed of the plurality of sets of rollers moving the sheet.

5. The method as in claim 1, further comprising a step of selectively opening and closing at least one valve to activate at least one of said plurality of motors.

6. The method as in claim 1, wherein at least one of said plurality of sensors is configured to control one of said plurality of motors, thereby actuating a respective one of the plurality of sets of rollers to stop moving.

7. The method as in claim 6: wherein after the sheet is folded a first time and the sheet is moved into the second position, another one of said plurality of sensors will detect a third notch and will signal to the controller to stop one of the plurality of motors which in turn stops a respective one of said plurality of sets of rollers.

8. The method as in claim 7, further comprising a step of stopping the sheet on the first fold line on the sheet so that the first fold line is aligned by being seated directly on top of the folding line of the folder.

9. The method as in claim 8, wherein the controller is also programmed to control an opening and closing of a set of valves which in turn control an amount of oil flow through said set of valves, thereby actuating the plurality of motors from the initial series circuit to the parallel circuit.

10. The method as in claim 9, wherein the oil flow is configured to control the folding of the sheet.

* * * * *